United States Patent [19]

Karmyshin et al.

[11] Patent Number: 4,488,757

[45] Date of Patent: Dec. 18, 1984

[54] PLOUGH MINING INSTALLATION

[75] Inventors: Nikolai V. Karmyshin; Evgeny I. Kudryashov; Vladimir M. Orlov; Vladimir M. Levashov; Vladimir N. Khorin; Alexandr D. Antonov, all of Moscow, U.S.S.R.

[73] Assignee: Gosudarstvenny Proektno -Konstruktorsky I Eksperimentalny Institut Ugolnoi Promyshlennosti, Moscow, U.S.S.R.

[21] Appl. No.: 486,993

[22] Filed: Apr. 21, 1983

[51] Int. Cl.[3] ..... E21C 29/02; E21C 27/40

[52] U.S. Cl. ..... 299/32; 299/34

[58] Field of Search ..... 299/43, 34, 32, 42; 91/167 R

[56] References Cited

U.S. PATENT DOCUMENTS 2,780,063 4/1961 Litz ..... 91/167 R
4,198,098 4/1980 Lobbe .

FOREIGN PATENT DOCUMENTS 760508 10/1956 United Kingdom .
690179 10/1979 U.S.S.R. ..... 299/34

*Primary Examiner*—Stephen J. Novosad
*Assistant Examiner*—Mark J. DelSignore
*Attorney, Agent, or Firm*—Fleit, Jacobson, Cohn & Price

[57] ABSTRACT

Disclosed is a plough mining installation for the underground working of minerals, preferably those occuring in thin seams, which incorporates plough bodies interlinked by rigid rods into a ploughing system reciprocating along the face due to a reciprocatory means consisting of an immovable hydraulic ram and a plurality of movable hydraulic rams. Spaced apart along a frame of the installation, the movable hydraulic rams are linked to each other by articulated joints resting on slides arranged to travel on longitudinal guide means. Thus, the ploughing systems is capable of reciprocating through a distance equalling the length of the aggragate stroke of all the hydraulic rams.

8 Claims, 14 Drawing Figures

PLOUGH MINING INSTALLATION

FIELD OF THE INVENTION

The invention relates to the underground equipment for the integrated mechanization of the winning of minerals, mainly in thin seams, and has specific reference to an installation designed to mine preferably coal, rock salt and shale.

BACKGROUND OF THE INVENTION

There is known a mining installation comprising a plurality of ploughs supported by a guide means attached to a conveyor and connected to a haulage means in the form of a chain passing over end sprockets. The haulage means connects to a reciprocatory means in the form of one or two hydraulic rams arranged parallel to the conveyor at the waste side thereof which cause the ploughs to reciprocate through a distance equalling the length of the stroke of a hydraulic ram (cf. United Kingdom Patent Specification No. 760,508; Cl. 68(1); published in 1956).

In the known installation, the haulage means can displace the ploughs through a distance equalling the length of the stroke of just one hydraulic ram. Therefore, to work a longwall face, many ploughs are required each utilized, however, not to its full capacity due to the conditions at the face which limit the output. Furthermore, the ploughs, all working at the same rate, are caused to move by a force which is only a fraction of the total pull exerted by the haulage means, this force changing inversely with the number of ploughs. The resulting low pull per plough enables the installation to cut only a narrow web so that neither an improvement in the degradation of the mineral mined nor a reduction of the power requirements and dust-forming tendency, as compared with a single-plough apparatus, are feasible to achieve.

The numerous ploughs the installation is provided with invite problems in adapting same to the remote or automatic control of the thickness of the web cut depending on the surface features of the seam floor.

Also known is another plough mining installation incorporating a face conveyor with a ramplike profile attached thereto, movable plough bodies which are fitted with nozzles emitting a fluid into the face under a high pressure and are interconnected by a flexible drive chain to form a common plough train, a driving means in the form of one or two hydraulic cylinders with a supply system which are immovably fitted to the conveyor frame and linked to the plough train, causing this to reciprocate on a guide means along the face through a distance equalling the length of the stroke of a hydraulic cylinder (cf. U.S. Pat. No. 4,198,098; Cl. 299/34).

It will be noted that this installation has much in common with the installation referred to above. This applies to the way of imparting the motive force to the ploughs, to arraning these into a train and to supporting the plough train on the frame of the installation. A salient feature of the last-named known installation is the hydraulic system feeding high-pressure fluid to the nozzles which emit it into the face. The use of the hydraulic working in stripping the coal enhances the efficiency of the installation but, at the same time, it limits the field of application thereof only to those cases where the mining conditions and sanitary regulations permit the use of hydraulicking.

SUMMARY OF THE INVENTION

It is an object of the present invention to provide a high-capacity plough mining installation for the integrated mechanization of the underground winning of minerals occuring in seams, mainly coal, shale and rock salt, which features a modified reciprocatory means enabling the blades of a ploughing system to slab off the web in large lumps, using a minimum number of ploughs, thus significantly reducing the degradation of the mineral mined, the power requirements and dust-forming tendency of the installation and simplifying the problem of adapting same to the remote or automatic control of the thickness of the web cut depending on the surface features of the seam floor.

In accordance with the above and other objects, in a plough mining installation comprising a plurality of plough bodies interlinked by longitudinal members into a ploughing system set to reciprocate on guide means of a frame of the installation along the face by a reciprocatory means incorporating at least one hydraulic ram, with a hydraulic system for feeding same with fluid, which is immovably attached to the frame of the installation and coupled to the ploughing system through its movable member, the reciprocatory means also incorporates according to the invention a plurality of movable hydraulic rams spaced apart along the frame of the installation and linked to each other by articulated joints resting on slides as well as by additional longitudinal guide means movably mounted whereon are the slides, an extreme movable hydraulic ram being pivotally attached to the movable member of the immovable hydraulic ram and the other extreme movable hydraulic ram being pivotally attached to the ploughing system.

The disclosed reciprocatory means realized in accordance with the invention offers the possibility of lengthening the working stroke of the plough bodies along the longwall face because of the stroke of the movable member of the immovable hydraulic ram and that of the movable member of each movable hydraulic ram out of their plurality linked to each other by the articulated joints resting on the slides are being added up. The slides movably mounted on the additional longitudinal guide means of the frame of the installation positively transmit the motive force from one hydraulic ram to the other in the course of their reciprocating motion.

The lengthening of the stroke of each plough body permits the working of a face by the longwall system with a reduced number of plough bodies. This implies that the disclosed reciprocatory means can provide for working a face of any length with a ploughing system comprised of three plough bodies. The outcome is, firstly, that the motive force applied to each plough body is high enough to enable this to loosen the web in large lumps—thus minimizing the degradation of the mineral cut and the dustforming tendency of the installation and significantly cutting the power requirements of the job—and, secondly, that the problem of adapting the plough bodies to the remote or automatic control of the thickness of the web cut depending on the surface features of the seam floor is significantly simplified.

It is expedient that the longitudinal members interlinking the plough bodies into the ploughing system are provided in the form of rigid rods pivotally linked to each other and provided with supports movably mounted on the guide means of the frame.

This feature of design allows for transmitting a motive force in either pushing or pulling to the plough bodies depending on the direction of travel and increasing this force to at least 1500 kN, simultaneously increasing the depth of cut to at least 200 mm (it will be noted that the known installations use chains incapable of sustaining the loads carried by rods). The resulting robustness of the structure provides for higher safety, especially in working pitching seams.

According to the invention, the reciprocatory means may incorporate a second plurality of movable hydraulic rams arranged, together with an immovable hydraulic ram, in opposition to the first plurality of hydraulic rams. This modification of the reciprocatory means increases the motive force applied to the plough bodies and assures a uniformity of the peak values of this force during the forward and backward strokes of the ploughing system, the fact that engaged in the simultaneous operation of the two oppposed pluralities of the hydraulic rams are different ends thereof providing for the uniformity irrespective of the direction of travel of the plough bodies.

It is also expedient that the two opposed pluralities of the hydraulic rams are interlinked by way of a carriage which is movably mounted on the guide means and pivotally attached to the longitudinal interconnecting members of the ploughing system. The function of the carriage incorporated into the reciprocatory means is to transmit to the ploughing system, having preferably an even number of plough bodies, the motive force produced by the movable hydraulic rams. Being stably mounted on the guide means, the carriage serves as a link which is pivotally attached to both the rigid rods of the ploughing system and the movable hydraulic rams of the two pluralities.

It is further expedient that a base plate giving support to a thrust means and the additional guide means of the reciprocatory means is attached to the frame of the installation along that side thereof which is opposite to the side arranged whereat is the ploughing system. This arrangement is intended to counteract the reactions and pull of gravity of the reciprocatory means and the plough bodies as well as the pull of gravity of the rood support in pitching seams which tend to displace the installation. Frictional forces arising due to the thrust means pressing the base plate against the floor and the roof support against the roof prevent the installation from displacing in operation. The thrust means can be secured to the base plate in a known way depending on the type of the roof support used.

To simplify the supply of the hydraulic rams of the reciprocatory means with fluid and to ease the remote control of the installation as a whole, it is preferred that the movable hydraulic rams are connected to the hydraulic system supplying fluid through the immovable hydraulic ram, the fluid being then fed from one movable hydraulic ram to another by way of a main passage formed by the pressure spaces of the rams, passages provided in the piston rods and lines provided at the articulated joints between the hydraulic rams. This plan provides for feeding the fluid to the movable hydraulic rams of the reciprocatory means of the plough bodies in a simple and reliable way. It also creates favourable conditions for supplying with the fluid special remotely-controlled hydraulic rams fitted to the plough bodies. The plough bodies fitted with the hydraulic rams controlling the operation of cutting heads can be hydraulically coupled to the hydraulic system via the main passage of the movable hydraulic rams and lines attached to the longitudinal interconnecting members of the ploughing system.

The remote control of cutting means in the known plough mining installations is a problem due to the difficulties arising in supplying power to these means fitted to the movable plough bodies.

The disclosed arrangement of the hydraulic system feeding fluid to the hydraulic rams controlling the operation of the cutting means of the plough heads solves the problem easily and reliably by channeling the fluid from the movable hydraulic rams to the movable plough bodies over lines fitted to the longitudinal interconnecting members of the ploughing system and, consequently, displacing integrally with the plough bodies.

According to the invention, it is also preferred that the movable hydraulic rams and the hydraulic rams controlling the operation of the cutting heads of the plough bodies are hydraulically interlinked in a known way so as to enable the cutting heads to be introduced into, and withdrawn from, the face in turns depending on the direction of travel of the ploughing system. The correlation of the direction of advance of a plough body with the introduction of a given set of blades of the articulated cutting head into the face can be obtained by resorting to known hydraulic arrangements for interconnecting the lines of the hydraulic rams imparting the reciprocating motion to the plough bodies and those lines of the hydraulic rams controlling the operation of cutting heads which are fitted to the longitudinal interconnecting members of the ploughing system. The above correlation may be varied depending on the pattern of operation of the plough bodies. For example, all cutting heads can be set to operate in the course of the traverse of the face by the plough bodies. Alternatively, a web of a given thickness can be cut in the course of two or more traverses of the face by the plough bodies, using for cutting only some of them while the rest will be clearing the face during each traverse. By assigning the plough bodies to different duties, the motive force concentrated at the plough bodies engaged in cutting is high enough for a successful ploughing of hard minerals.

All in all, the disclosed plough mining installation is a high-capacity machine meeting high safety standards and designed with an eye to the integrated mechanization of the underground mining of minerals of any hardness occuring in flat and pitching seams, preferably coal, shale and rock salt. It is capable of shearing off the mineral from solid faces in lumps with a constant thickness of 200 mm and upwards and is therefore conducive to a minimal degradation of the mineral cut, a material suppression of the dust-forming tendency of the ploughing operation and shrunken power requirements of this operation. The disclosed installation also creates the prospect of a remotely-controlled or automated mining with optional human attendance.

BRIEF DESCRIPTION OF THE DRAWINGS

The invention will now be described by way of an example with reference to the accompanying drawings, wherein.

DETAILED DESCRIPTION OF THE PREFERRED EMBODIMENT

The plough mining installation according to the invention incorporates a frame supporting and guiding the installation in operation, a ploughing system and a reciprocatory means displacing the ploughing system back and forth along the face, all described in detail hereinbelow.

Figure 1:
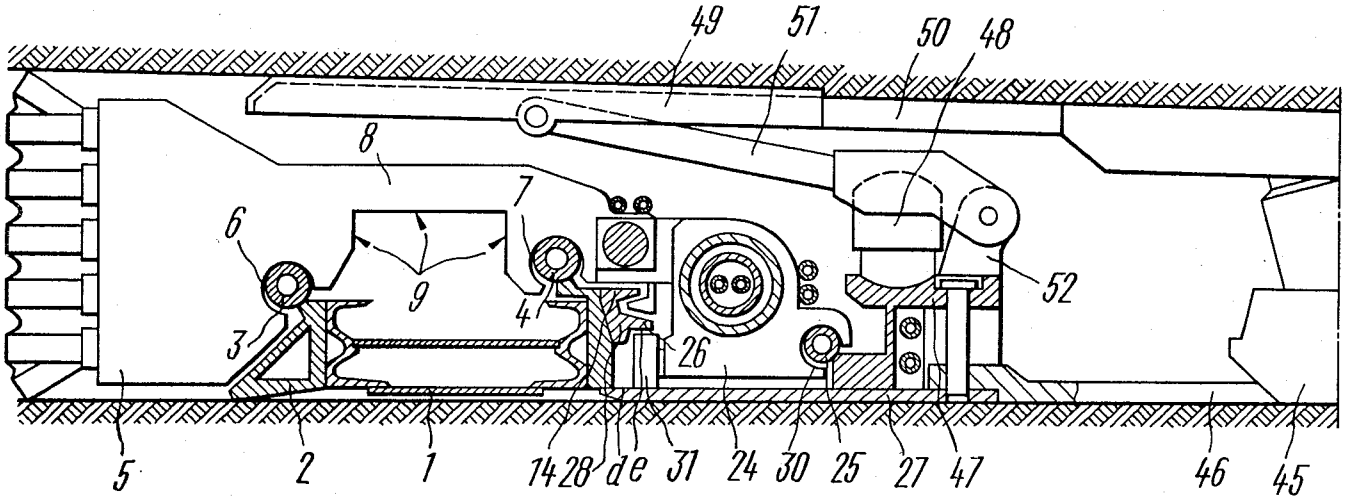
FIG. 1 is a schematic cross sectional view of the plough mining installation according to the invention at the face.

Referring to FIG. 1, the frame 1 of the installation is in fact the frame of a known apparatus for hauling the mineral mined which can be, depending on the pitch of the seam, either a face conveyor or a trough (not shown). A ramplike profile 2 and tubular guide means 3, 4 are attached to the sides of the frame 1.

Mounted on the tubular guide means 3 and 4 with provision for lengthwise displacement, using embracing brackets 6 and 7, there are plough bodies 5. A recess 9 in portion 8 of each plough body 5 provides passage for the mineral hauled on the face conveyor.

Figure 2:
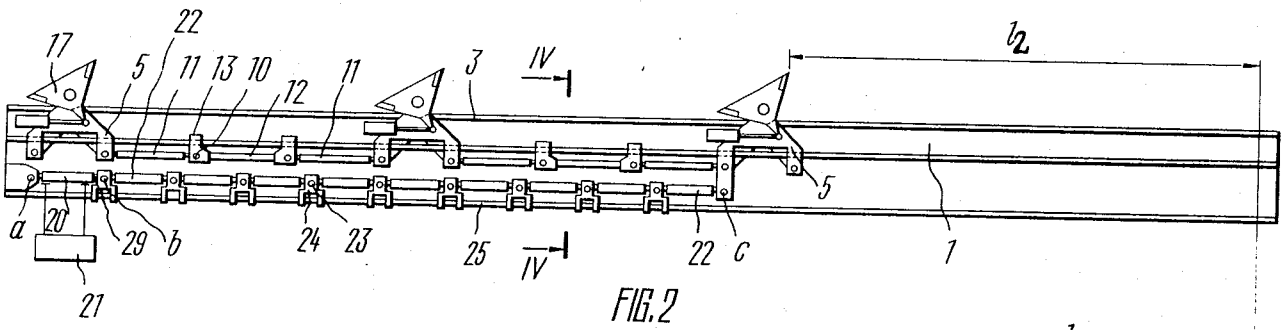
FIG. 2 is a schematic plan view of the installation according to the invention showing the ploughing system of three plough bodies in the initial position and the reciprocatory means of the ploughing system comprised of a plurality of movable hydraulic rams.
Figure 3:
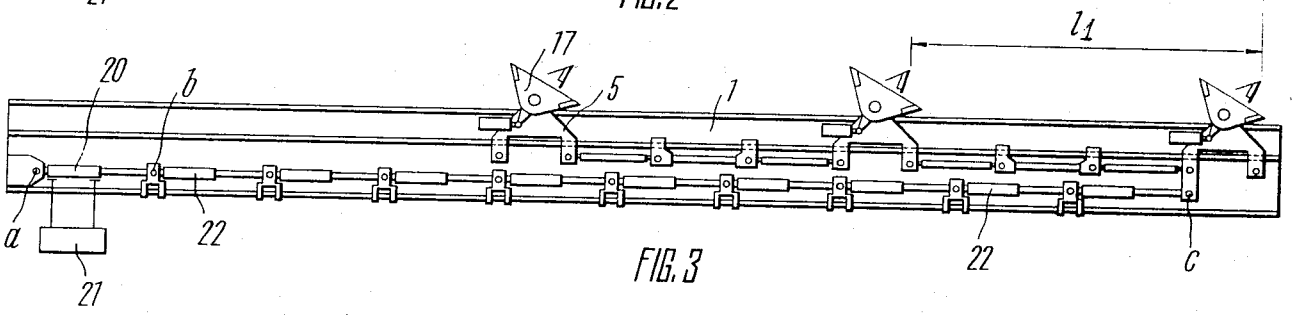
FIG. 3 is a view similar to that of FIG. 2 with the ploughing system displaced into the endmost position.
Figure 4:
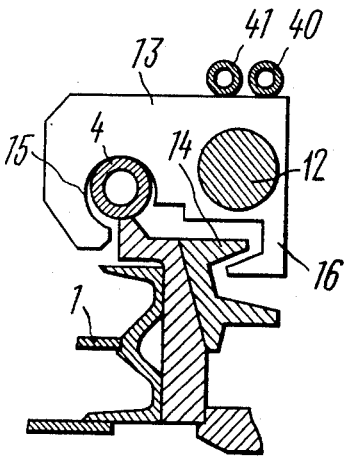
FIG. 4 is a section on line IV—IV of FIG. 2, turned through 90 deg.

Referring to FIGS. 2 and 3, the plough bodies 5 are interlinked, to form a ploughing system, by longitudinal members provided in the form of alternating rigid rods 11 and 12 with articulated joints 10 therebetween. The rods 12 are provided each with two brackets 13 (FIG. 4) capable of displacing in the longitudinal direction along the tubular guide means 4 and a flat guide means 14 which are attached to a side of the frame 1. The brackets 13, being held fast to the tubular guide means 4 due to an annular recess 15 and to the flat guide means 14 due to a projection 16, enable the rods 12 freely to displace only along the guide means in transmitting the motive force in pulling an pushing to each other and to the plough bodies.

Each plough body 5 (FIG. 5) is provided with a known articulated cutting head 17 with one or two sets of blades 18 depending on whether the plough bodies are arranged to shear in one or two directions, respectively. The blades 18 are introduced into, and withdrawn from, the face by pivoting the cutting head 17, using a hydraulic ram 19.

Referring to FIGS. 2 and 3, the reciprocatory means of the ploughing system incorporates at least one hydraulic ram 20, with a hydraulic system 21 feeding fluid thereinto, which is immovably attached to an end of the frame 1 at point a. Also incorporated into the reciprocatory means is a movable plurality of hydraulic rams 22 spaced apart along the frame 1 between points b and c and linked to each other by articulated joints 23 resting on slides 24. Further incorporated into the reciprocatory means are additional guide means of the tubular type 25 and of the flat type 26 (FIG. 1) movably mounted whereon are the slides 24. The additional guide means 25 and 26 are fitted to a base plate 27 resting on the floor and secured to the frame 1 and along same at the side opposite to that located whereat is the ploughing system. The flat guide means 14 and 26 are both attached to a subframe 28.

An extreme hydraulic ram 22 (FIGS. 2, 3) of the movable plurality is linked at point b to the movable member (piston rod) 29 of the immovable hydraulic ram 20 and the other extreme hydraulic ram 22 of the movable plurality is pivotally linked to a plough body 5 of the ploughing system at point c. The articulated joint 23 between the hydraulic rams 22 can be of any known construction, including one illustrated in FIG. 5.

The reciprocatory means of the ploughing system according to the invention is arranged to displace this system through a distance equalling the length of the aggregate stroke of the hydraulic rams 22 (FIGS. 2, 3) of the movable plurality located between points b and c plus that of the stroke of the immovable hydraulic ram 20. The motive force produced by the hydraulic rams 20 and 22 is one in pushing for displacing the ploughing system in one direction and in pulling for the travel in the opposite direction.

For an efficient transmission of the motive force from one hydraulic ram to another and, eventually, to the ploughing system, especially if the shearing is effected in two directions, the slides 24, integrally with the articulated joints 23 fitted thereto, are movably mounted on an additional tubular guide means 25 by way of bearings 30 (FIG. 1) with annular recesses and bearings 31 housed in recesses formed by surface d of the base plate 27 and surface e of the additional flat gide means 26.

The slides 24 of the installations designed to work thick seams can be fitted with rolling-contact bearings.

To augment the motive force applied to the plough bodies and assure uniformity of this force at its peak values in the course of the forward and backward strokes of the ploughing system, the reciprocatory means may incorporate two opposed pluralities of movable hydraulic rams 22 (FIGS. 6 and 7) each pivotally linked to the movable member 29 of an appropriate immovable hydraulic ram 20 fitted to the frame 1.

Figures 6, 7:
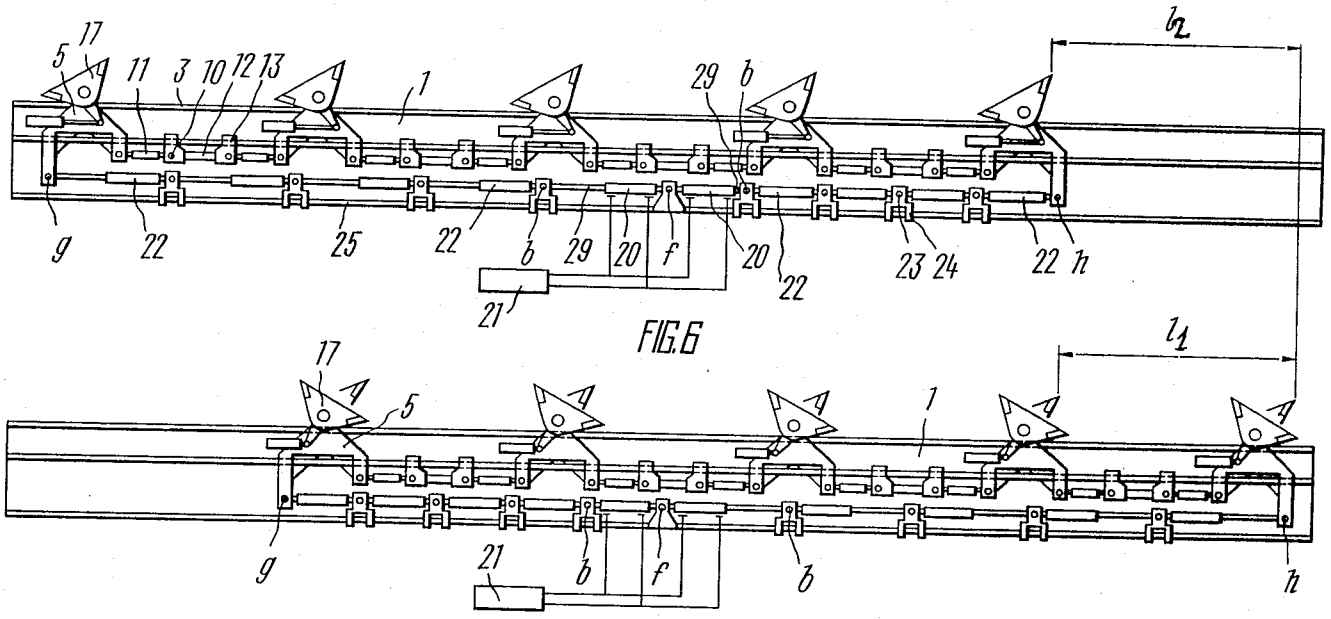
FIG. 6 is a schematic plan view of the mining installation according to the invention wherein the reciprocatory means of the ploughing system, this being illustrated in the initial position, comprises two pluralities of movable hydraulic rams arranged in opposition at a point attached whereat are the immovable hydraulic rams.
FIG. 7 is a view similar to that of FIG. 6, whowing the ploughing system displaced into the endmost position.

The immovable hydraulic rams 20 may have different spatial arrangements. Referring to FIGS. 6 and 7, the hydraulic rams 20 can be arranged in the middle of the frame 1, being pivotally attached thereto at point f, and the extreme hydraulic rams 22 of the movable plurality can be coupled to the extreme plough bodies 5 of the ploughing system at points g and h.

Figure 10:
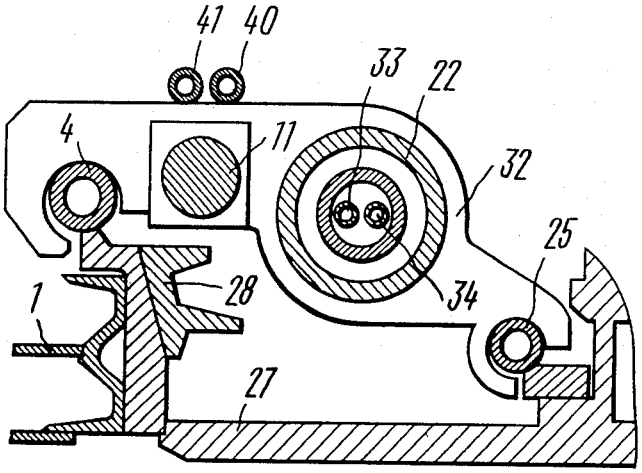
FIG. 10 is a section on line X—X of FIG. 8, turned through 90 deg.
Figure 8:
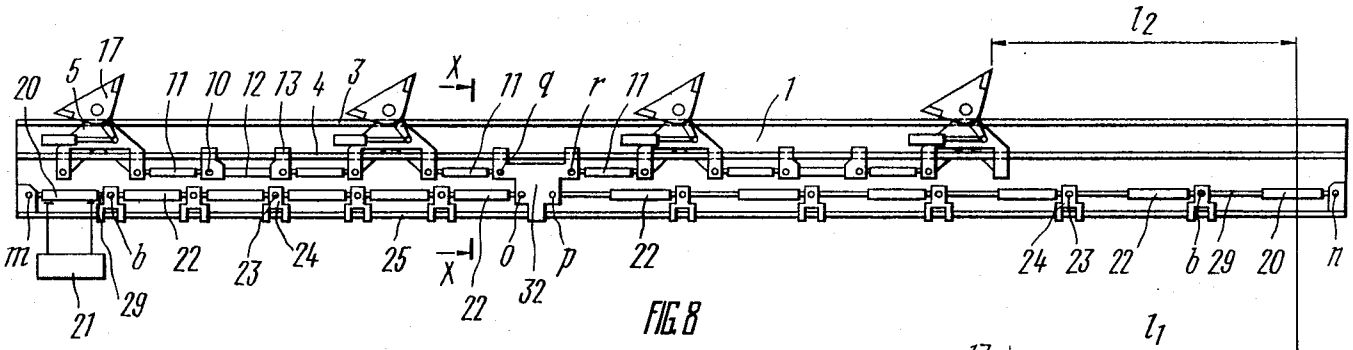
FIG. 8 is a schematic plan view of the mining installation according to the invention wherein the reciprocatory means of the ploughing system, this being shown in the initial position, comprise two pluralities of movable opposed hydraulic rams interlinked by the carriage.
Figure 9:
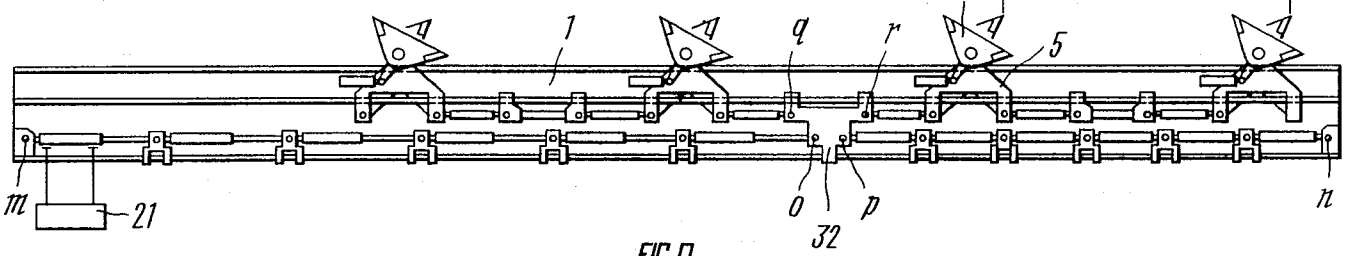
FIG. 9 is a view similar to that of FIG. 8, showing the ploughing system displaced into the endmost position.

Referring to FIGS. 8 and 9, the immovable hydraulic rams 20 are arranged at the ends of the frame 1, being pivotally attached thereto at points m and n. Then, the extreme hydraulic rams 22 of both movable pluralities are pivotally interlinked at points o and p through a carriage 32 which, by analogy with the rods 12, is mounted on the tubular guide means 4 and the flat guide means 14 (FIG. 4) and pivotally linked to the rods 11 of the ploughing system at points q and r (FIGS. 8 and 9). The carriage 32, in a modification illustrated in FIG. 10, is supported by the tubular guide means 4 and 25.

Since the two pluralities of hydraulic rams 22 setting to reciprocate the plough bodies disposed according to FIG. 6 between points g-f and f-h, and according to FIG. 8 between points m-o and p-n are arranged in an opposed manner, operating in turns at a time are different ends of the rams (head ends and rod ends). Therefore, the aggregate area of the pistons of the hydraulic rams producing the motive force is always the same irrespectively of the direction of travel of the plough bodies.

The hydraulic rams 20 and 22 of the reciprocatory means can be made to extend in one or more steps.

The number of the hydraulic rams included the reciprocatory means is chosen so as to work the face under the existing conditions with a minimum number of plough bodies. The arrangements depicted in FIGS. 2, 6 and 8 call for using between three and five plough bodies each set to reciprocate through a distance equalling the length of the aggregate stroke of a plurality of the hydraulic rams extendable in one step in order to work a longwall face of any extent. The motive force applied in this case per plough body will be sufficiently high to shear off the mineral, e.g. coal, in lumps at leat 200 mm thick.

The fluid supplied by the hydraulic system 21 comprising pumps and lines is admitted into the hydraulic ram 20 immovably attached at point m (FIGS. 5 and 8), reaching hence the movable hydraulic rams 22 arranged between points b and o via the main passage formed by the rod ends s (FIG. 5) and head ends t of the hydraulic rams 22, passages 33 and 34 in the piston rods 35 and lines 36, 37 provided at the articulated joints 23 between the hydraulic rams 22; the passages 33 in conjunction with the lines 36 interconnecting the rod ends s of the hydraulic rams 20 and 22 and the passages 34 in conjunction with the lines 37 interconnecting the head ends t of the same hydraulic rams.

Referring to FIG. 8, the other plurality of the movable hydraulic rams arranged between points p and n is hydraulically coupled to the first plurality of the hydraulic rams arranged between points m and o by way of lines 38 (FIG. 5) and 39 fitted to the carriage 32. To co-ordinate the operation of the hydraulic rams 22 comprising the two pluralities, the line 38 connects the head ends of the hydraulic rams in the first plurality with the rod ends of the hydraulic rams in the second plurality and the line 39 provides communication between the rod ends and head ends of the two pluralities, respectively. The result is that depending on the direction of travel of the plough bodies, one plurality of the hydraulic rams exerts a pushing motive force and the other, a pulling one.

The hydraulic rams 19 serving to control the operation of the cutting head 17 the plough bodies are fitted with have their head ends t interconnected with the rod ends s by way of lines 40 and 41, respectively, which are attached to the longitudinal interconnecting members 11, 12 and the carriage 32 (FIG. 10) of the ploughing system in a known way. The lines 40 and 41 (FIG. 5) connect to the hydraulic system 21 via lines 42 and 43 fitted to the carriage 32 or one of the plough bodies 5 (not shown) and via the lines 38, 39 of the movable hydraulic rams 22.

Figure 5:
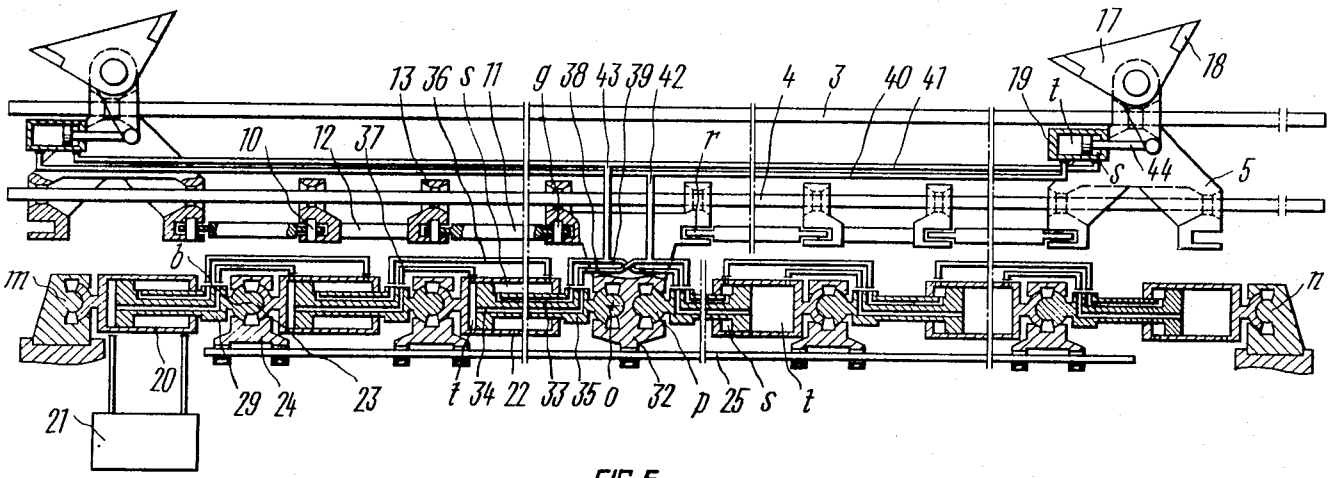
FIG. 5 is a schematic view of the hydraulic system of the plough mining installation according to the invention wherein the reciprocatory means of the ploughing system comprises two pluralities of movable hydraulic rams and a carriage.

The hydraulic rams 19 of the cutting heads 17 provided on the plough bodies 5 are hydraulically coupled to the movable hydraulic rams 22 in a known way so as to permit the sets of the blades 18 to be automatically introduced into, and withdrawn from, the face depending on the direction of travel of the ploughing system. Referring for example to FIG. 5, this can be done due to the head ends t of the movable hydraulic rams 22 arranged between points b and o being connected to the head ends of the control hydraulic rams 19 through the lines 38, 42, 40 and the rod ends s of the same hydraulic rams being interconnected via the lines 39, 43, 41. The fluid entering, for example, the head ends t of the hydraulic rams 20, 22, 19 will cause the plough system to displace rightwards (in the plane of the drawing). The articulated cutting heads 17 of the plough bodies 5 will be turned counter-clockwise by the piston rods 44 of the hydraulic rams 19, being thus set into the working position appropriate for a given direction of travel of the plough bodies.

It goes without saying that the disclosed plough mining installation is used in mining operations in conjunction with other equipment known to those versed in the art which can be, for example, a hydraulic roof support consisting of individual chocks 45 (FIG. 1) linked to the frame 1 by bars 46 and a number of thrust means 47 spaced apart along the face on a base plate 27.

Illustrated in FIG. 1 is, for example, a known thrust means 47 coupled to a chock 45 of the hydraulic roof support and arranged to press the frame 1 against the floor with the aid of a hydraulic prop 48 so as to prevent the frame 1 against displacement on its own accord due to the reactions of the reciprocatory means and ploughing system and the pull of gravity of the installation in pitching seams. A canopy 49 connecting to a support member 50 of the chock 45 and operated by the hydraulic prop 48 through the intermediary of an arm 51 pivotally attached to the canopy 49 and a bracket 52 supports the roof at the face. This arrangement also prevents the roof support against sliding on its own accord in pitching seams and provides thereto guidance in the course of advance.

Very long faces can be worked by several mining installations each provided with the reciprocatory means of the disclosed construction or the recourse can be to one mining installation having a number of disclosed reciprocatory means.

The disclosed plough mining installation operates on the following lines.

Generally, the mineral is mined by the plough bodies employed all at a time which work the face within the assigned area in a shuttlewise manner. In the initial position, an extreme plough body 5 is set at the beginning of the face as shown in FIGS. 2, 6, 8, 11, 13 and the rest are spaced equidistantly apart as determined by the length of the interconnecting rods 11 and 12.

Since the hydraulic rams 19 are hydraulically coupled to the hydraulic rams 22 of the reciprocatory means, as shown in FIG. 5, a set of blades 18 appropriate for a given direction of displacement of the plough bodies 5 automatically begins operation due to the cutting head 17 being turned by the hydraulic ram 19 as soon as fluid is admitted into the hydraulic rams 22. At the same time, the reciprocatory means cause the plough bodies 5 to displace through a distance equalling the length of the aggregate stroke of the piston rods 35 of the movable hydraulic rams 22 plus that of the stroke of the piston rod 29 of the immovable hydraulic ram 20. Responsible for the displacement in one direction are the motive forces in pushing which arise in the head ends of the hydraulic rams whereas the displacement in the opposite direction results from the motive forces in pulling which are set up in the rod ends of the same rams.

The strokes produced by the piston rods of the hydraulic rams are added up beginning from the immovable hydraulic ram 20 located at point a. Any succeeding movable hydraulic ram 22 which has been shifted forward due to the strokes of the piston rods of the preceding hydraulic rams, displaces, in its turn, all the succeeding movable hydraulic rams through a distance equalling the length of its own displacement plus the length of the stroke of its piston rod. Thus, displacing through a maximum distance will be point c whereat the last movable hydraulic ram connects to the ploughing system.

The movable hydraulic rams of the reciprocatory means which are arranged between points g-f and f-h as shown in FIG. 6 and between points m-o and p-n as indicated in FIG. 8 produce the motive force at different ends at a time, i.e. rod ends and head ends, alternating the ends depending on the direction of travel of the plough bodies. The aggregate pressure area of the hydraulic rams inducing the motion is constant in this case irrespectively of the direction of travel of the ploughing system which sustains both the pushing and pulling motive forces at a time.

Figures 11, 12, 13, 14:
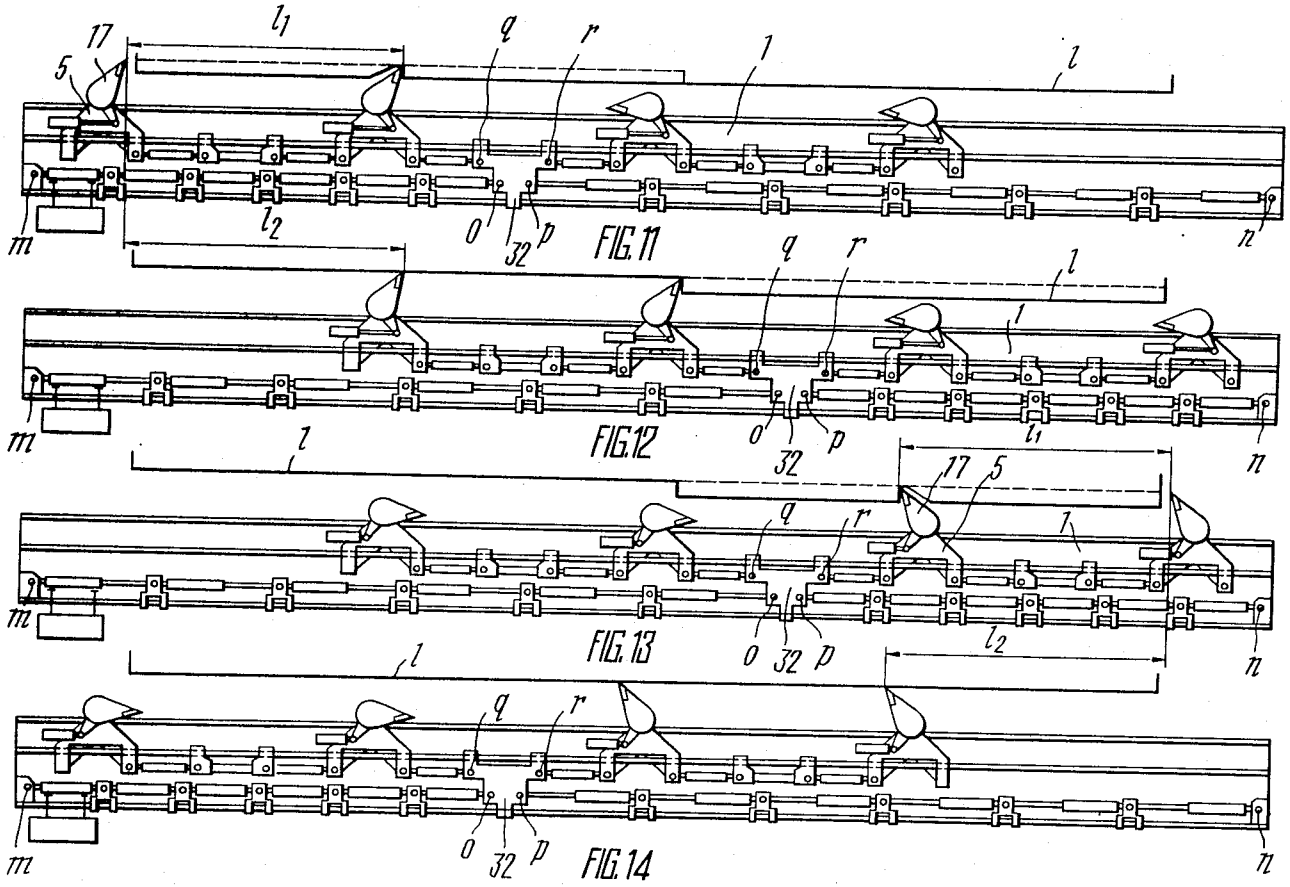
FIGS. 11 through 14 are schematic representations of the mining installation according to the invention in operation at the face, using four pairwise grouped plough bodies, FIGS. 11, 12 depicting the leftward pair and FIGS. 13, 14 presenting the rightward pair of plough bodies in the initial and endmost working positions, respectively.

Referring to FIGS. 11 and 12, a given length $l_2$ of the stroke each of the plough bodies is making in shearing off the web is slightly longer (by 0.5 to 1 m) than the spacing $l_1$ of the plough bodies in the system. The mineral cut is loaded on the face conveyor, when this can be used, by the recourse to a known technique. At the instant the ploughing system reverses the direction of travel, the frame is advanced towards the face through a distance equalling a given depth of cut in any known way, for example, with the aid of the chocks 45 of the hydraulic roof support.

A practical method of mining consists in grouping the plough bodies into gangs and cutting a web of a given thickness in a number of passes of the ploughing system all the way down the face equalling the number of gangs. Used for cutting the mineral in this case during each pass are only some of the plough bodies making up the ploughing system, the rest being engaged in clearing the face. The assignment of the plough bodies to different duties enables those of them which are engaged in cutting to apply a concentrated force capable of shearing off hard minerals.

The manner in which the plough bodies can be ganged up is exemplified in FIGS. 11 and 12 showing the left-hand gangs in the initial and endmost positions, respectively. Similarly, FIGS. 13 and 14 depict the right-hand gangs in the same positions.

The mining method illustrated in FIGS. 11 through 14 provides for a continuous advance of the frame 1 of the installation towards the face at a rate assuring a constant given depth of cut. The roof at the face is supported by the canopies 49 (FIG. 1), which are being advanced integrally with the frame 1, and by the support members 50 of the chocks 45 spaced apart along the face. The chocks are advanced towards the face, using any known system of remote control.

The above features of design and operation of the disclosed plough mining installation create the prospect of mining by remote control or automatically with an optional human attendance at the face. The force concentrated at the blades of the ploughing bodies in this case is sufficiently high to cut the mineral from a solid face in lumps with a thickness of at least 200 mm which is a factor conducive to a minimal degradation of the mineral mined, e.g. coal, a suppressed dust-forming tendency of the installation and materially reduced power requirements of the breaking operation.

What is claimed is:

1. A plough mining installation comprising a frame; guide means attached to said frame; a plurality of plough bodies mounted on said guide means; longitudinal members interlinking said plough bodies into a ploughing system capable of being reciprocated back and forth along the face of the frame by a reciprocatory means; said reciprocatory means causing said ploughing system to reciprocate back and forth along said face, said means incorporating at least one hydraulic ram immovably attached to said frame, a plurality of movable hydraulic rams and additional guide means attached to said frame along the side thereof opposite said ploughing system; said movable hydraulic rams comprising said plurality being spaced apart along said frame and being linked to each other by articulated joints, an extreme movable hydraulic ram being pivotally linked to the movable member of said immovable hydraulic ram and the other extreme movable hydraulic ram being pivotally linked to said ploughing system; slides giving support to said articulated joints between said movable hydraulic rams, said slides being movably mounted on said additional guide means.

2. A plough mining installation as claimed in claim 1, wherein said longitudinal members of said ploughing system are provided in the form of rigid rods pivotally linked to each other and provided with supports movably mounted on said guide means.

3. A plough mining installation as claimed in claim 1, wherein said reciprocatory means incorporates a second plurality of movable hydraulic rams which is arranged, together with an immovable hydraulic ram, in opposition to said first plurality of movable hydraulic rams.

4. A plough mining installation as claimed in claim 3, wherein said two pluralities of movable hydraulic rams are pivotally linked to each other by way of a carriage which is movably mounted on said guide means and pivotally linked to said longitudinal members of said ploughing system.

5. A plough mining installation as claimed in claim 1, wherein incorporated are a known thrust means and a base plate, said base plate being attached to said frame along that side thereof opposite said ploughing system; said base plate giving support to said thrust means and said additional guide means of said reciprocatory means.

6. A plough mining installation as claimed in claim 1, wherein said movable hydraulic rams comprising said plurality are connected to the hydraulic system supplying fluid through said immovable hydraulic ram, said fluid being then fed from one said movable hydraulic ram to another by way of a main passage formed by the pressure spaced of said movable hydraulic rams, passages provided in the piston rods of said movable hydraulic rams and lines provided at said articulated joints between said movable hydraulic rams.

7. A plough mining installation as claimed in claim 6, wherein the plough bodies are provided with hydraulic rams controlling the operation of known cutting heads, said hydraulic rams being hydraulically coupled to said hydraulic system supplying said fluid through said main passage of said movable hydraulic rams and lines fitted to the longitudinal members of the ploughing system.

8. A plough mining installation as claimed in claim 7, wherein the two pluralities of movable hydraulic rams and said hydraulic rams controlling the operation of said cutting heads are hydraulically coupled in a known way so as to enable said cutting heads to be introduced into, and withdrawn from, the face alternately depending on the direction of travel of the ploughing system.

* * * * *